US010861363B2

(12) United States Patent
Muraki

(10) Patent No.: US 10,861,363 B2
(45) Date of Patent: Dec. 8, 2020

(54) DISPLAY DRIVER, ELECTRONIC APPARATUS, AND MOBILE BODY

(71) Applicant: SEIKO EPSON CORPORATION, Tokyo (JP)

(72) Inventor: Norichika Muraki, Hara-mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/449,634

(22) Filed: Jun. 24, 2019

(65) Prior Publication Data

US 2019/0392742 A1 Dec. 26, 2019

(30) Foreign Application Priority Data

Jun. 25, 2018 (JP) ..... 2018-119539

(51) Int. Cl.
*G09G 3/00* (2006.01)
*G09G 3/36* (2006.01)
*G09G 3/32* (2016.01)

(52) U.S. Cl.
CPC ..... *G09G 3/006* (2013.01); *G09G 3/32* (2013.01); *G09G 3/3611* (2013.01); *G09G 2330/12* (2013.01); *G09G 2380/10* (2013.01)

(58) Field of Classification Search
CPC ..... G09G 3/32; G09G 3/006; G09G 3/3611
See application file for complete search history.

(56) References Cited

U.S. PATENT DOCUMENTS

2011/0316765 A1* 12/2011 John ..... G09G 3/006 345/76
2012/0036418 A1 2/2012 Morino et al.
2014/0118370 A1* 5/2014 Hakura ..... G06T 17/20 345/522
2015/0317198 A1* 11/2015 Kume ..... G06F 11/0787 714/6.11
2016/0275837 A1 9/2016 Toyoshima et al.
2017/0278441 A1* 9/2017 Ooki ..... G09G 3/3648
2018/0240397 A1* 8/2018 Hara ..... G06F 3/048

FOREIGN PATENT DOCUMENTS

JP 2007-286305 A 11/2007
JP 2015-131635 A 7/2015
JP 2016-177279 A 10/2016
JP 6044316 B2 12/2016
JP 2017-181574 A 10/2017

* cited by examiner

*Primary Examiner* — Ariel A Balaoing
(74) *Attorney, Agent, or Firm* — Oliff PLC

(57) ABSTRACT

A display driver (100) includes a drive circuit (130) that drives an electro-optical panel (200), a control circuit (110) that controls the drive circuit (130), an error detection circuit (115) that detects an error in the display driver (100), and a counter (125) that performs count processing with respect to information regarding the number of times of error detection in an operating period of the display driver (100). The control circuit performs control such that information regarding the accumulated number of times of detection of the error is stored in a nonvolatile memory that can retain storage contents even if power is not supplied, based on the information regarding the number of times of detection.

14 Claims, 7 Drawing Sheets

DISPLAY DRIVER, ELECTRONIC APPARATUS, AND MOBILE BODY

The present application is based on, and claims priority from JP Application Serial Number 2018-119539, filed Jun. 25, 2018, the disclosure of which is hereby incorporated by reference herein in its entirety.

BACKGROUND

1. Technical Field

The present disclosure relates to a display driver, an electronic apparatus, a mobile body, and the like.

2. Related Art

A display device includes an electro-optical panel and a display driver that drives the electro-optical panel. The display driver is provided with an error detection circuit in order to detect various errors in the display driver. The information obtained in error detection is transmitted to a host, for example, and the host determines whether or not an anomaly is present based on the received information.

A known technique regarding error detection is disclosed in JP-A-2016-177279, for example. In the technique disclosed in JP-A-2016-177279, when a failure in a display signal is detected, a first signal is output, and the number of times of consecutive detection of the first signal is acquired. Then, whether or not an anomaly is present is determined based on the number of times of detection. Also, in the technique disclosed in JP-A-2016-177279, an accumulated number of times of the number of times of consecutive detection of the first signal is acquired. If the number of times of consecutive detection of the first signal is n1, and the number of times of consecutive detection of the first signal is n2, which is obtained next time, n1+n2 is acquired as the accumulated number of times of detection. Also, whether or not an anomaly is present is determined based on the accumulated number of times of detection.

If a display driver notifies a host of an error every time the display driver detects an error, the processing load of the host increases. Therefore, it is desirable that the display driver notifies the host of an error based on the accumulated number of times of error detection. However, when an operating period of the display driver is ended, the number of times of error detection is reset, and therefore the display driver cannot retain an accumulated number of times of detection over a plurality of operating periods. For example, in the technique disclosed in JP-A-2016-177279, an accumulated number of times of detection in a situation in which a display is continuously driven is acquired. That is, a technique for retaining the accumulated number of times of detection when the display driving is turned off once is not disclosed in JP-A-2016-177279.

SUMMARY

An aspect of the present disclosure relates to a display driver that includes a drive circuit that drives an electro-optical panel and a control circuit that controls the drive circuit. The display driver includes: an error detection circuit configured to detect an error in the display driver; and a counter configured to perform count processing with respect to information regarding the number of times of detection of the error in an operating period of the display driver. The control circuit performs control such that information regarding the accumulated number of times of detection of the error is stored in a nonvolatile memory that can retain storage contents even if power is not supplied, based on the information regarding the number of times of detection.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

The following is a detailed description of preferred embodiments of the present disclosure. Note that the embodiments described below are not intended to unduly limit the content of the invention recited in the claims, and all of the configurations described in the embodiments are not necessarily essential as solutions provided by the present disclosure.

1. Display Driver

Figure 1:
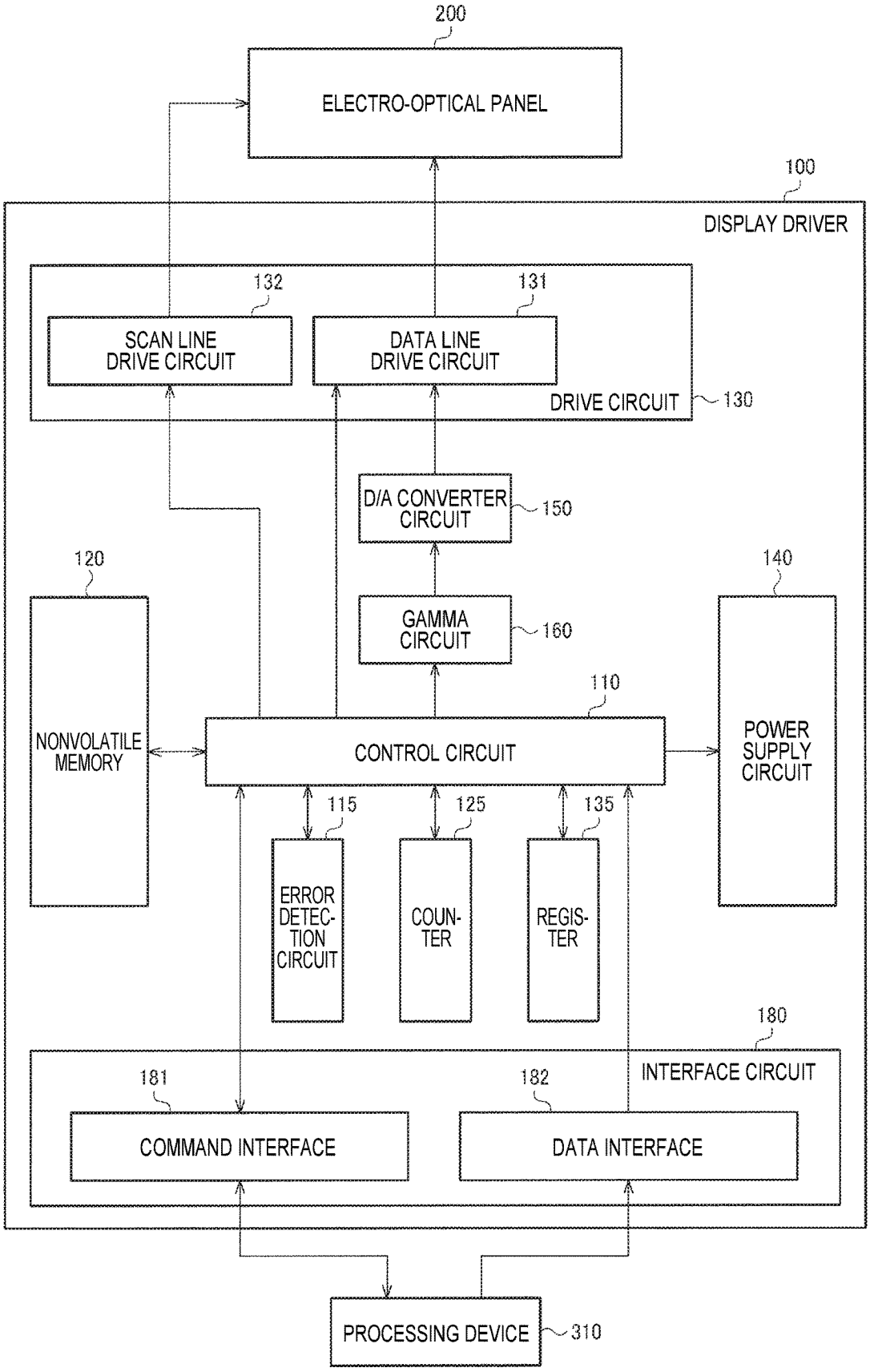
FIG. 1 shows an exemplary configuration of a display driver.

FIG. 1 shows an exemplary configuration of a display driver 100. The display driver 100 includes a control circuit 110, an error detection circuit 115, a nonvolatile memory 120, a counter 125, a drive circuit 130, a register 135, a power supply circuit 140, a D/A converter circuit 150, a gamma circuit 160, and an interface circuit 180.

The display driver 100 displays an image corresponding to display data in an electro-optical panel 200 by driving the electro-optical panel 200 based on the display data transmitted from a processing device 310. The display data may also be referred to as image data.

The processing device 310 is a processor or ASIC (Application Specific Integrated Circuit), for example, and is a controller for controlling the display driver 100. The processor is a CPU (Central Processing Unit), an MPU (Micro Processor Unit), a DSP (Digital Signal processor), or the like. For example, the processing device 310 controls the display driver 100 by transmitting a command or setting data to the display driver 100. Alternatively, the processing device 310 controls the display driver 100 by transmitting a synchronizing signal and a data enable signal to the display driver along with the display data.

The electro-optical panel 200 includes a pixel array, a plurality of scan lines, and a plurality of data lines. One scan line and one data line are coupled to each pixel included in the pixel array. When one scan line is selected (activated), voltages of data lines are applied to respective pixels coupled to this scan line. The voltage of a data line may also be referred to as a data voltage. The electro-optical panel 200 is a liquid—crystal display panel or an EL (Electra Luminescence) display panel.

Hereinafter, the units of the display driver 100 will be described.

The drive circuit 130 drives the electro-optical panel 200. The drive circuit 130 includes a scan line drive circuit 132 that drives scan lines of the electro-optical panel 200 and a data line drive circuit 131 that drives data lines of the electro-optical panel 200. The scan line drive circuit 132 includes a plurality of buffer circuits, and one buffer circuit drives one scan line. The data line drive circuit 131 includes a plurality of amplifier circuits. Each amplifier circuit outputs a data voltage to a corresponding data line by amplifying or buffering an output voltage of a D/A converter circuit 150.

The D/A converter circuit 150 performs D/A conversion on display data. That is, the D/A converter circuit 150 selects a voltage corresponding to the display data from a plurality of voltages, and outputs the selected voltage to a corresponding amplifier circuit. The display data is data with which a plurality of tone values can be expressed. The gamma circuit 160 generates a plurality of voltages corresponding to the plurality of tone values. The gamma circuit 160 may also be referred to as a tone voltage generation circuit.

The control circuit 110 controls the display driver 100. That is, the control circuit 110 sets a drive timing of the electro-optical panel 200 based on a synchronizing signal supplied from the processing device 310. Also, the control circuit 110 outputs display data supplied from the processing device 310 to the D/A converter circuit 150.

Also, the control circuit 110 reads out setting data stored in the register 135, and performs operation setting of the display driver 100 based on the setting data. For example, the setting data is data indicating the number of pixels in a vertical direction and the number of pixels in a horizontal direction of the electro-optical panel 200. The control circuit 110 sets the number of scan lines and the number of data lines according to the setting data. The number of scan lines is a number of lines that are scanned by the scan line drive circuit 132. The number of data lines is a number of lines that are scanned by the data line drive circuit 131. Also, the control circuit 110 accesses the nonvolatile memory 120. That is, the control circuit 110 transmits an address, data, and a write signal to the nonvolatile memory 120. The nonvolatile memory 120 writes the data to a memory region designated by the address. Also, the control circuit 110 transmits an address and a readout signal to the nonvolatile memory 120. The nonvolatile memory 120 reads out data from a memory region designated by the address, and transmits the read-out data to the control circuit 110. The control circuit 110 is constituted by a logic circuit.

The control circuit 110 is a gate array circuit or a standard cell array circuit, for example. Note that the gate array circuit is an array circuit in which logic cells are automatically placed and signal lines are automatically routed. Also, in the standard cell array circuit, each logic cell is a standardized cell. The standard cell array circuit is an array circuit in which signal lines are automatically routed in a logic cell array.

The interface circuit 180 performs communication between the processing device 310 and the display driver 100. The interface circuit 180 includes a command interface 181 and a data interface 182.

The command interface 181 receives a command and setting data from the processing device 310. The control circuit 110 writes data, which corresponds to the command, to the register 135. Hereinafter, this data is referred to as command data. For example, when the command interface 181 receives a display-on command, the control circuit 110 writes command data indicating display-on to the register 135. Also, the control circuit 110 writes setting data to the register 135. Also, the command interface 181 transmits data to the processing device 310. For example, when the command interface 181 receives a register readout command, the control circuit 110 reads out a register value from the register 135. The command interface 181 transmits the read-out register value to the processing device 310. The command interface 181 adopts an interface such as an SPI (Serial Peripheral Interface) system, an I2C (Inter Integrated Circuit) system, or the like.

The data interface 182 receives display data, a vertical synchronizing signal, a horizontal synchronizing signal, and a data enable signal from the processing device 310. The data interface 182 receives display data when the data enable signal is enabled. The data interface 182 may adopt an interface such as an LVDS (Low Voltage Differential Signaling) system, an RGB serial interface system, or the like.

The error detection circuit 115 detects an error occurring in the display driver 100, and when an error is detected, activates an error detection signal. The error means that the display driver 100 enters a state that is different from the state in which the display driver 100 operates properly, or that parameters used by the display driver 100 such as voltages deviate from a normal range. For example, the error detection circuit 115 detects one or more errors of a display data error, a register error, and a voltage error. Note that the error detection will be described in detail later. When a plurality of types of errors are detected, a plurality of detection signals are output. These plurality of detection signals are denoted by first to $k^{th}$ detection signals. k is an integer of 2 or more. Here, the error detection circuit 115 outputs a logical sum of the first to $k^{th}$ detection signals as an ultimate error detection signal. That is, when one of the first to $k^{th}$ detection signals is activated, the error detection signal is activated. Note that the error detection circuit 115 may divide the first to $k^{th}$ detection signals into a plurality of groups, and generate an error detection signal for each group. In this case, the number of times of detection is counted in each group, and an accumulated number of times of detection is acquired for each group.

The counter 125 performs count processing, and outputs a count value. The count value is information regarding the number of times of detection indicating the number of times of error detection. The count value may be a number of times of error detection itself, or a value that, instead of being a number of times of error detection itself, is based on the number of times of error detection, Specifically, when the error detection signal is activated j times, the control circuit 110 outputs a pulse signal to the counter 125. j is an integer of 1 or more. The counter 125 increments the count value based on the pulse signal from the control circuit 110. Note that when j=1, the error detection signal may be directly input to the counter 125. In this case, the counter 125 increments the count value based on the error detection signal.

The control circuit 110 writes information regarding the accumulated number of times of detection to the nonvolatile memory 120 based on the count value output from the counter 125. This operation will be described in detail later. The accumulated number of times of detection is an accumulated number of times of error detection, and the information regarding the accumulated number of times of detection is information indicating the accumulated number of times of detection. The information regarding the accumulated number of times of detection may be an accumulated number of times of detection itself, or a value, instead of being an accumulated number of times of detection, based on the accumulated number of times of detection. For example, the information regarding the accumulated number of times of detection may be updated when the count value exceeds i. The information regarding the accumulated number of times of detection indicates an accumulated number of times of detection in a period from when the display driver 100 was stated to be used until now, for example.

The nonvolatile memory 120 is a nonvolatile storage device, and is a device that can retain data even if the power supply is turned off. The nonvolatile memory 120 includes a plurality of word lines, a plurality of bit lines, and a plurality of memory cells. Also, the nonvolatile memory 120 can include a word line selection circuit for selecting a word line, a readout control circuit that performs control when data is read out from a memory cell, and a write control circuit that performs control when data is written in a memory cell.

The readout control circuit includes sense amplifiers that are coupled to bit lines. When the nonvolatile memory 120 receives an address, data, and a write signal, the word line selection circuit selects a word line corresponding to the address, and the write control circuit outputs signals corresponding to the data to the bit lines. With this, the data is written in memory cells that are coupled to the selected word line. When the nonvolatile memory 120 receives an address and a readout signal, the word line selection circuit selects a word line corresponding to the address. With this, signals from memory cells coupled to the selected word line are output to the bit lines. The readout control circuit reads out data based on the signals.

The nonvolatile memory 120 is an OTP (One Time Programmable) device, for example. A FAMOS (Floating gate Avalanche injection MOS) or the like may be used as the nonvolatile memory 120. The FAMOS is a type of memory in which charges are accumulated in a floating gate through avalanche injection. Alternatively, the nonvolatile memory 120 may be an EEPROM (Electrically Erasable Programmable Read Only Memory) in which data can be electrically erased. Alternatively, the nonvolatile memory 120 may be a memory using fuse cells. In this type of memory, a fuse cell, which is a memory cell, includes a resistance element and a selector element that is coupled in series to the resistance element. The selector element is a PN junction diode, for example. Note that the selector element may be a MOS transistor. For example, one end of the resistance element is coupled to a bit line, and the other end of the resistance element is coupled to an anode of the diode. A cathode of the diode is coupled to a word line. The resistance element that functions as the fuse element is a programmable resistor whose resistance is variable. For example, the resistance element includes a polysilicon resistor whose resistance is high, and a silicide layer that is formed on the polysilicon resistor and whose resistance is low. The silicide layer is blown out by a large current being caused to flow therethrough, which causes the resistance of the resistance element is changed from a low resistance to a high resistance, and as a result, data is stored in the fuse element, which is a memory cell.

The register 135 stores setting data and command data. For example, the register 135 includes a plurality of latch circuits or a plurality of flip-flop circuits, and the plurality of latch circuits or the plurality of flip-flop circuits store the setting data and the command data. Note that the register 135 and the counter 125 may be integrally constituted with the control circuit 110 by a gate array circuit or a standard cell circuit.

The power supply circuit 140 includes a plurality of voltage generation circuits, and the plurality of voltage generation circuits generates various voltages based on a system power supply. The various voltages are voltages that are used inside the display driver 100, and are voltages that are supplied to the drive circuit 130, the gamma circuit 160, the control circuit 110, and the like. The voltage generation circuit is constituted by a charge pump circuit, a regulator, or the like.

Note that the nonvolatile memory 120 may be provided outside the display driver 100. In this case, the interface circuit 180 includes a memory interface. Also, the control circuit 110 accesses the nonvolatile memory 120 via the memory interface.

2. Operations

Figure 2:
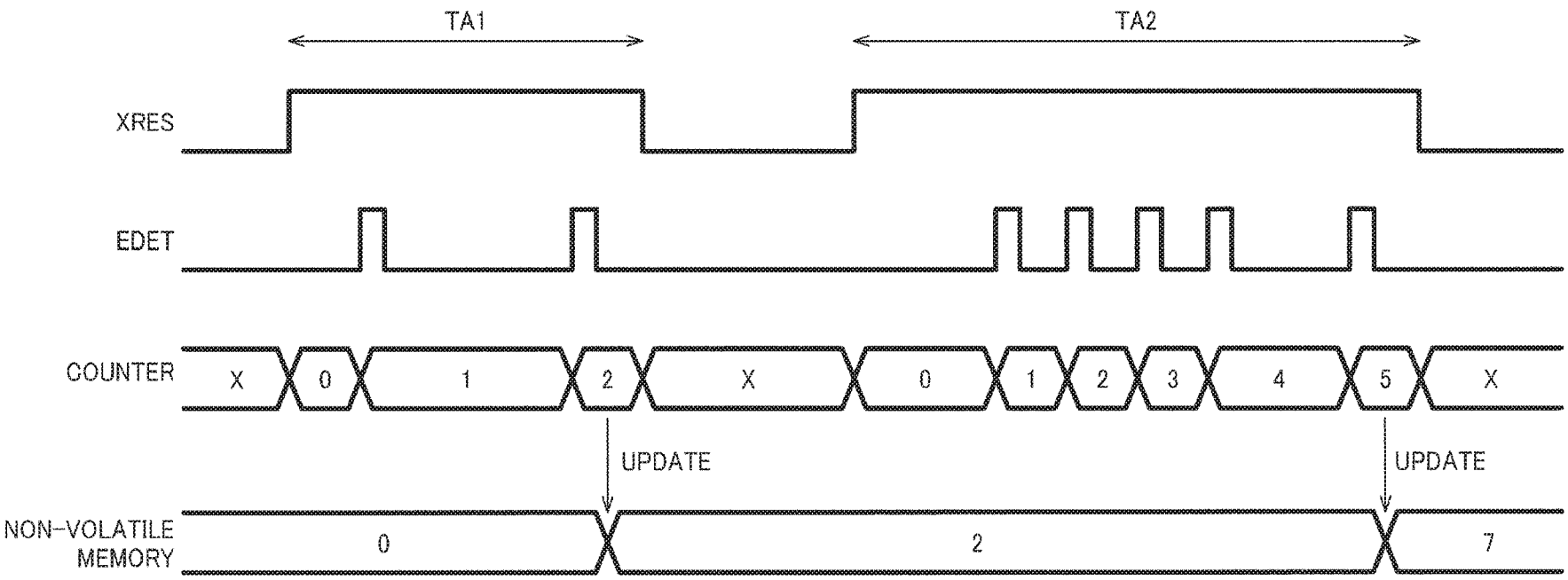
FIG. 2 is a timing chart illustrating operations of the display driver.

FIG. 2 is a timing chart illustrating operations of the display driver 100. Note that, in FIG. 2, a case where the error detection circuit 115 outputs one error detection signal EDET, and the counter 125 counts the number of times of error detection is described as an example. When the error detection circuit 115 outputs a plurality of error detection signals, operations similar to those in FIG. 2 are performed for each error detection signal.

As shown in FIG. 2, the processing device 310 outputs a reset signal XRES to a reset terminal, which is not illustrated, of the display driver 100. When the reset signal XRES is at a low level, the display driver 100 is in a non-operating state, and when the reset signal XRES is at a high level, the display driver 100 is in an operating state. Here, the period in which the reset signal XRES is at a high level is referred to as an operating period of the display driver 100. Note that, in the following, the shift of the operating state of the display driver 100 from the operating state to the non-operating state, which is caused by the reset signal XRES, is also referred to as a reset. Also, the non-operating state may also be referred to as a reset state. Also, the shift of the operating state of the display driver 100 from the non-operating state to the operating state, which is caused by the reset signal XRES, is also referred to as reset-cancelling. Also, the operating state may also be referred to as a reset-cancelled state. In FIG. 2, a first operating period is denoted by TA1, and a second operating period, which follows the first operating period, is denoted by TA2. For example, when the power supply of the electronic apparatus including the display driver 100 is turned on, the reset of the display driver 100 is cancelled, and when the power supply of the electronic apparatus is turned off, the display driver 100 is set to a reset state. If the electronic apparatus is an on-board apparatus, the power supply of the on-board apparatus is turned on or off by an ignition key, for example.

The counter 125 is in a reset state in a period other than the operating periods TA1 and TA2. When the reset signal XRES shifts from a low level to a high level, the reset of the counter 125 is cancelled, and the count value is initialized to "0". When the error detection circuit 115 detects an error, the error detection signal EDET is activated. In FIG. 2, pulse signals indicate activated state. The counter 125 increments the count value when the error detection signal EDET is activated. If the error detection signal EDET is activated twice in the operating period TA1, the count value at the end of the operating period TA1 is "2". The control circuit 110 writes the count value of "2" at the end of the operating period TA1 to the nonvolatile memory 120. That is, the accumulated number of times of detection stored in the nonvolatile memory 120 is updated from "0" to "2".

In the operating period TA2 as well, the counter 125 counts the number of times of error detection, similarly to the operating period TA1. The count value at the end of the operating period TA2 is assumed to be "5". The control circuit 110 updates the accumulated number of times of detection stored in the nonvolatile memory 120 from "2" to "7" based on the count value of "5" at the end of the operating period TA2. For example, the control circuit 110 adds the count value of "5" to the accumulated number of times of detection of "2" read out from the nonvolatile memory 120, and writes the sum of "7" to the nonvolatile memory 120. Alternatively, the control circuit 110 additionally writes the count value of "5" in a memory region that is different from the memory region in which the accumulated number of times of detection of "2" is stored. When the accumulated number of times of detection is read out, the control circuit 110 reads out "2" and "5", and acquires the accumulated number of times of detection of "7" by adding them.

According to the embodiment described above, the display driver 100 includes the drive circuit 130 that drives the electro-optical panel 200, the control circuit 110 that controls the drive circuit 130, the error detection circuit 115 that detects an error in the display driver 100, and the counter 125 that performs count processing with respect to information regarding the number of times of detection of an error in the operating period of the display driver 100. The control circuit 110 performs control such that the information regarding the accumulated number of times of error detection is stored in the nonvolatile memory 120 that can retain stored data even if the power supplied is turned off based on the information regarding the number of times of detection.

According to the present embodiment, the information regarding the accumulated number of times of error detection is written into the nonvolatile memory 120 based on the information regarding the number of times of detection of an error acquired in the operating period of the display driver 100. With this, even after the operating period of the display driver 100 has ended, the nonvolatile memory 120 can retain the information regarding the accumulated number of times of detection. With this, the display driver 100 can output information regarding the accumulated number of times of detection over a plurality of operating periods to the processing device 310, and the processing device 310 can determine whether or not the display driver 100 is in an anomalous state based on the information regarding the accumulated number of times of detection.

For example, when a display driver is mounted in an on-board device, there is a risk that an error frequently occurs in the display driver due to EMI (Electro Magnetic Interference) and the like. A known display driver may notify the processing device every time an error occurs. In this case, the processing load of the processing device increases. For example, a display driver outputs an interrupt signal to the processing device when detecting an error. The processing device, upon receiving an interrupt signal, needs to perform processing in correspondence with the signal. Therefore, when an error occurs frequently, the processing load of the processing device increases. Also, the processing device, upon receiving an interrupt signal, resets a display system, for example. When the display system is reset, the display is turned off once. Therefore, if an error occurs frequently and the display system is reset frequently, the display is repeatedly turned off, and an appropriate display cannot be performed.

According to the present embodiment, the processing device 310 can determine whether or not the display driver 100 is in an anomalous state based on information regarding the accumulated number of times of detection. With this, the frequency of processing in correspondence with the anomalous state is reduced, and the load of the processing device 310 can be reduced. Also, since the frequency of the display system being reset is reduced, an appropriate display can be performed.

Also, in a known display driver, when an error is resolved after the error has been detected, an error flag may be deactivated. That is, it is possible that the period during which the error flag is activated is short. For example, an error flag is generated for each type of the error, and the error flag is stored in a register. The processing device, upon receiving an interrupt signal, reads out an error flag via an interface. Here, if the period during which the error flag is activated is short, it is possible that the processing device cannot recognize the error.

According to the present embodiment, when errors are detected, the counter 125 counts the number of times of error detection. Also, the information regarding the accumulated number of times of detection is stored in the nonvolatile memory 120 based on the number of times of error detection. With this, even an error that cannot be recognized by accessing the register, as described above, can be counted, and the number of times of error detection is accumulated as the information regarding the accumulated number of times of detection. That is, even an error with respect to which the period during which an error flag is activated is short can be counted, and the processing device 310 can recognize the number of times of error occurrence with the information regarding the accumulated number of times of detection.

3. Detailed Configuration and Operations

Hereinafter, the detailed configuration and operations of the display driver 100 will be described.

A method of updating the information regarding the accumulated number of times of detection will be described taking a case where the nonvolatile memory 120 is an OTP memory as an example.

Figure 3:
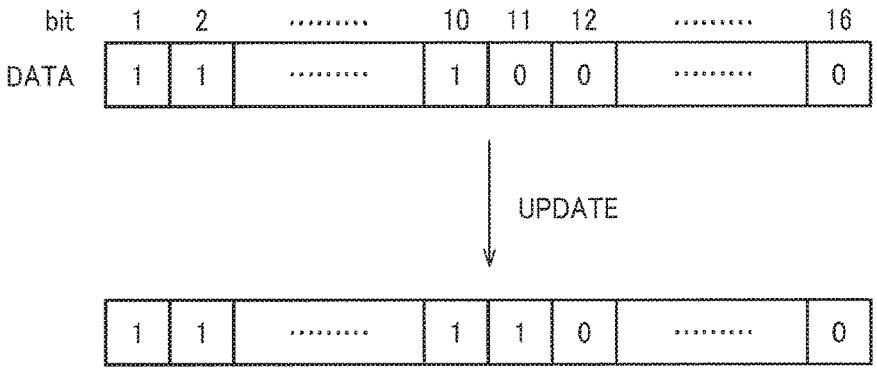
FIG. 3 is a diagram illustrating a first method for updating information regarding the accumulated number of times of detection.

FIG. 3 is a diagram illustrating a first method for updating information regarding the accumulated number of times of detection. In FIG. 3, one word of the nonvolatile memory 120 consists of 16 bits. FIG. 3 shows bits of one word. Note that the information regarding the accumulated number of times of detection may be stored in a plurality of words.

Before updating, "1" is stored in bits from a first bit to a tenth bit, and "0" is stored in bits from an eleventh bit to a sixteenth bit. Assume that the counter 125 outputs a count value of "1" when an operating period of the display driver 100 is ended. The control circuit 110 updates the information regarding the accumulated number of times of detection by writing "1" to the eleventh bit. Note that, if the count value is "2", the control circuit 110 writes "1" to the eleventh and twelfth bits.

When the control circuit 110 reads out the information regarding the accumulated number of times of detection from the nonvolatile memory 120, 16-bit data is read out.

"1" is read out from each of 11 bits of the 16 bits. In this case, the accumulated number of times of detection is "11".

Note that the information regarding the accumulated number of times of detection may be updated when the count value exceeds i. Assume that i=100, and the count value is "120" when the operating period of the display driver 100 is ended. In this case, the control circuit 110 obtains the quotient "1" of the division 120/100. Then, the control circuit 110 updates the information regarding the accumulated number of times of detection by writing "1" to the eleventh bit. Since "1" is written in 11 bits of 16 bits, the accumulated number of times of detection is "1100".

Figure 4:
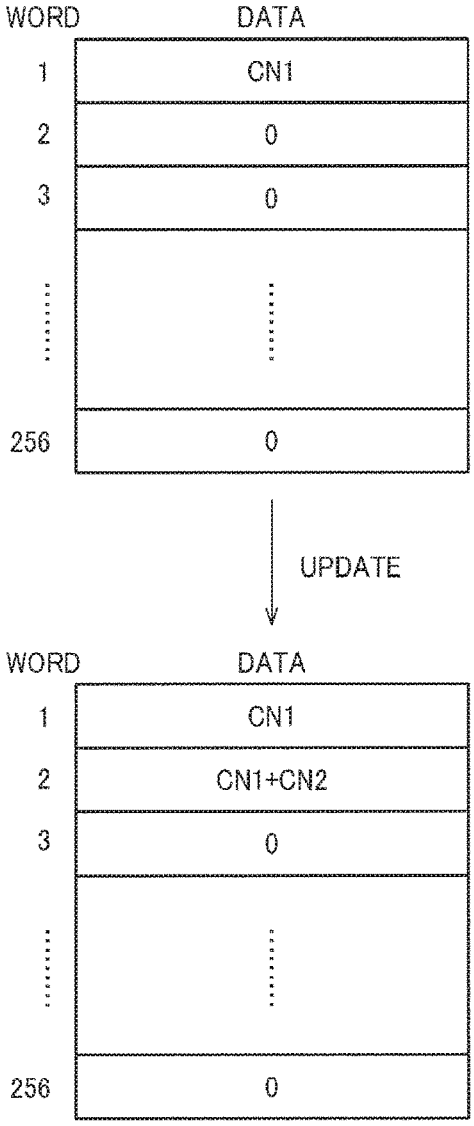
FIG. 4 is a diagram illustrating a second method for updating information regarding the accumulated number of times of detection.

FIG. 4 is a diagram illustrating a second method for updating information regarding the accumulated number of times of detection. In FIG. 4, 256 words of the nonvolatile memory 120 are assigned as the storage region of the information regarding the accumulated number of times of detection.

Before updating, the accumulated number of times of detection CN1 is stored in a first word, Assume that the counter 125 outputs a count value CN2 when the operating period of the display driver 100 is ended. The control circuit 110 obtains the accumulated number of times of detection, which is CN1+CN2, and writes the accumulated number of times of detection, which is CN1+CN2, to a second word of the nonvolatile memory 120.

When the control circuit 110 reads out the information regarding the accumulated number of times of detection from the nonvolatile memory 120, the control circuit 110 reads out the information regarding the accumulated number of times of detection from the word, of the first to $256^{th}$ words, to which the information regarding the accumulated number of times of detection was written most recently. In FIG. 2, the control circuit 110 reads out the information regarding the accumulated number of times of detection, which is CN1+CN2, from the second word.

Note that the information regarding the accumulated number of times of detection may be updated when the count value exceeds i. The quotient of the division CN1/*i* is denoted as CN1', and the quotient of the division CN2/*i* is denoted as CN2'. Before updating, the accumulated number of times of detection CN1' is stored in the first word. The control circuit 110 updates the information regarding the accumulated number of times of detection by writing CN1'+CN2' to the second word of the nonvolatile memory 120.

According to the embodiment described above, the control circuit 110 updates the information regarding the accumulated number of times of detection by writing information based on the information regarding the number of times of detection to a memory region that is different from the memory region of the nonvolatile memory 120 in which the information regarding the accumulated number of times of detection before updating is stored.

In the example in FIG. 3, the memory region in which the information regarding the accumulated number of times of detection before updating is stored consists of the first to tenth bits, and the memory region that is different from this memory region is the eleventh bit. The information based on the information regarding the number of times of detection is "1" that is to be written in the eleventh bit. In this case, the information based on the information regarding the number of times of detection is the information regarding the number of times of detection. In the example in FIG. 4, the memory region in which the information regarding the accumulated number of times of detection before updating is stored is the first word, and the memory region that is different from this memory region is the second word. The information based on the information regarding the number of times of detection is CN1+CN2 that is to be written in the second word. In this case, the information based on the information regarding the number of times of detection is the information regarding the accumulated number of times of detection.

The OTP memory is a memory in which data can be written to each memory region only once. According to the present embodiment, new information regarding the accumulated number of times of detection is written to a memory region in which information regarding the accumulated number of times of detection is not written. With this, when the nonvolatile memory 120 is an OTP memory, the information regarding the accumulated number of times of detection can be updated based on the information regarding the number of times of detection of an error.

Note that, a case where the nonvolatile memory 120 is an OTP (One Time Programmable) memory has been described above as an example. Note that the nonvolatile memory 120 may be a memory that can be re-written a plurality of times. In this case, the information regarding the accumulated number of times of detection after updating may be written to a memory region that stores the information regarding the accumulated number of times of detection before updating.

Next, the operations of the display driver 100 while power is supplied to the display driver 100, and the state transition in the display driver 100 will be described.

Figure 5:
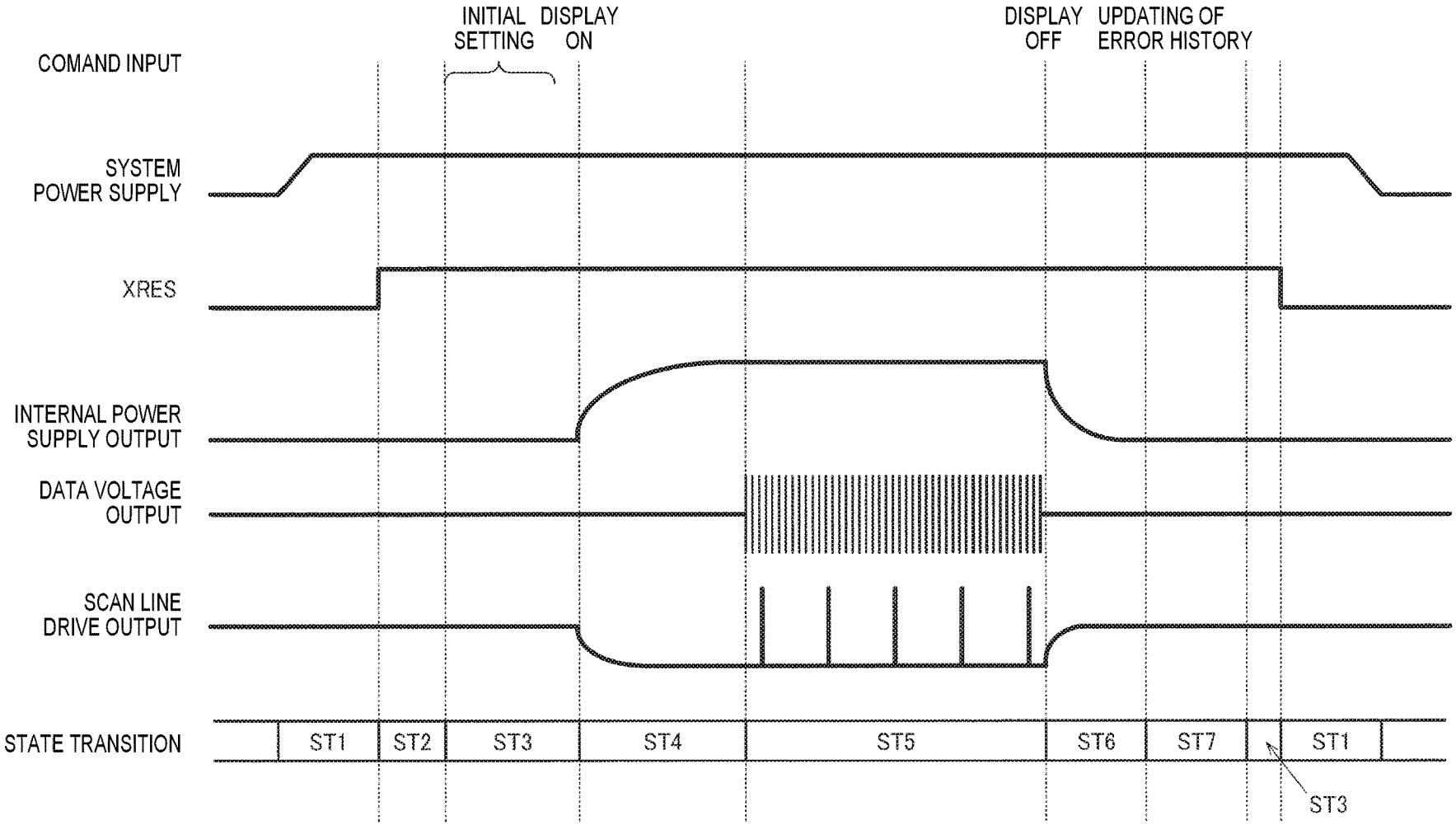
FIG. 5 is a waveform diagram illustrating operations of the display driver.

FIG. 5 is a waveform diagram illustrating operations of the display driver 100. The control circuit 110 includes a state machine, and the state machine controls the state transition. Outline of each state is described in FIG. 5. The state transition will be described in detail later.

As shown in FIG. 5, when a system power supply is turned on, the display driver 100 is set to state ST1. State ST1 is a reset state. The system power supply is a power supply that supplies power to the display system. The display system includes the display driver 100, the processing device 310, and the electro-optical panel 200.

When the processing device 310 changes the reset signal XRES from a low level to a high level, the state machine causes the state to transition from state ST1 to state ST2, In state ST2, the control circuit 110 reads out information regarding the accumulated number of times of detection from the nonvolatile memory 120, and stores the information regarding the accumulated number of times of detection in the register 135, With this, a state is entered in which the processing device 310 can read out the information regarding the accumulated number of times of detection via the command interface 181.

Next, the state machine causes the state to transition from state ST2 to state ST3. State ST3 is a standby state. When an initial setting command is input from the processing device 310 in state ST3, the control circuit 110 loads initial setting data from the nonvolatile memory 120 to the register 135. The initial setting data is data for setting operations of the display driver 100. The initial setting data includes data indicating the number of pixels in a vertical direction and the number of pixels in a horizontal direction of the electro-optical panel 200, data for setting the tone characteristics of the gamma circuit 160, data for setting voltages to be supplied from the power supply circuit 140 to the drive circuit 130, data for setting voltages to be supplied from the power supply circuit 140 to the gamma circuit 160, and the like. The initial setting data is stored in the nonvolatile memory 120 in advance. For example, the initial setting data is written into the nonvolatile memory 120 when an electronic apparatus including the display driver 100 is manufactured or the like.

The processing device 310 transmits a display-on command to the display driver 100. The state machine causes the state to transition from state ST3 to state ST4 based on the display-on command. In state ST4, a power on sequence is executed. The power supply circuit 140 includes a plurality of voltage generation circuits, as described above. The power supply circuit 140 sequentially turns on the plurality of voltage generation circuit according to a turning-on sequence.

Next, the state machine causes the state to transition from state ST4 to state ST5. State ST5 is a state in which the electro-optical panel 200 performs display. That is, the scan line drive circuit 132 sequentially selects the scan lines of the electro-optical panel 200, and the data line drive circuit 131 applies data voltages to the pixels coupled to the selected scan line.

The processing device 310 transmits a display-off command to the display driver 100. The state machine causes the state to transition from state ST5 to state ST6 based on the display-off command. In state ST6, a power off sequence is executed. That is, the power supply circuit 140 sequentially turns off the plurality of voltage generation circuits according to a turning-off sequence.

Next, the state machine causes the state to transition from state ST6 to state ST7. In state ST7, the information regarding the accumulated number of times of detection is updated. That is, the control circuit 110 writes the latest information regarding the accumulated number of times of detection into the nonvolatile memory 120.

Next, the state machine causes the state to transition from state ST7 to state ST3, which is a standby state. When the processing device 310 changes the reset signal XRES from a high level to a low level, the state machine causes the state to transition from state ST3 to state ST1. Thereafter, the system power supply is turned off.

Note that although a case has been described above where the control circuit 110 updates the information regarding the accumulated number of times of detection at the end of the operating period, the case to which the present disclosure can be applied is not limited thereto.

For example, the control circuit 110 may regularly update the information regarding the accumulated number of times of detection stored in the nonvolatile memory 120 in the operating period. For example, when p is an integer of one or more, the control circuit 110 may update the information regarding the accumulated number of times of detection stored in the nonvolatile memory 120 every p frames. The frame corresponds to a vertical scan period when the display driver 100 drives the electro-optical panel 200.

Alternatively, the control circuit 110 may update the information regarding the accumulated number of times of detection stored in the nonvolatile memory 120 on the condition that the number of times of detection indicated by the information regarding the number of times of detection exceeds a threshold value. For example, when the threshold value is 100, the information regarding the accumulated number of times of detection is updated every time an error is detected 100 times. When the updating method described in FIG. 3 is used, "1" may be written in one bit every time an error is detected 100 times.

Figure 6:
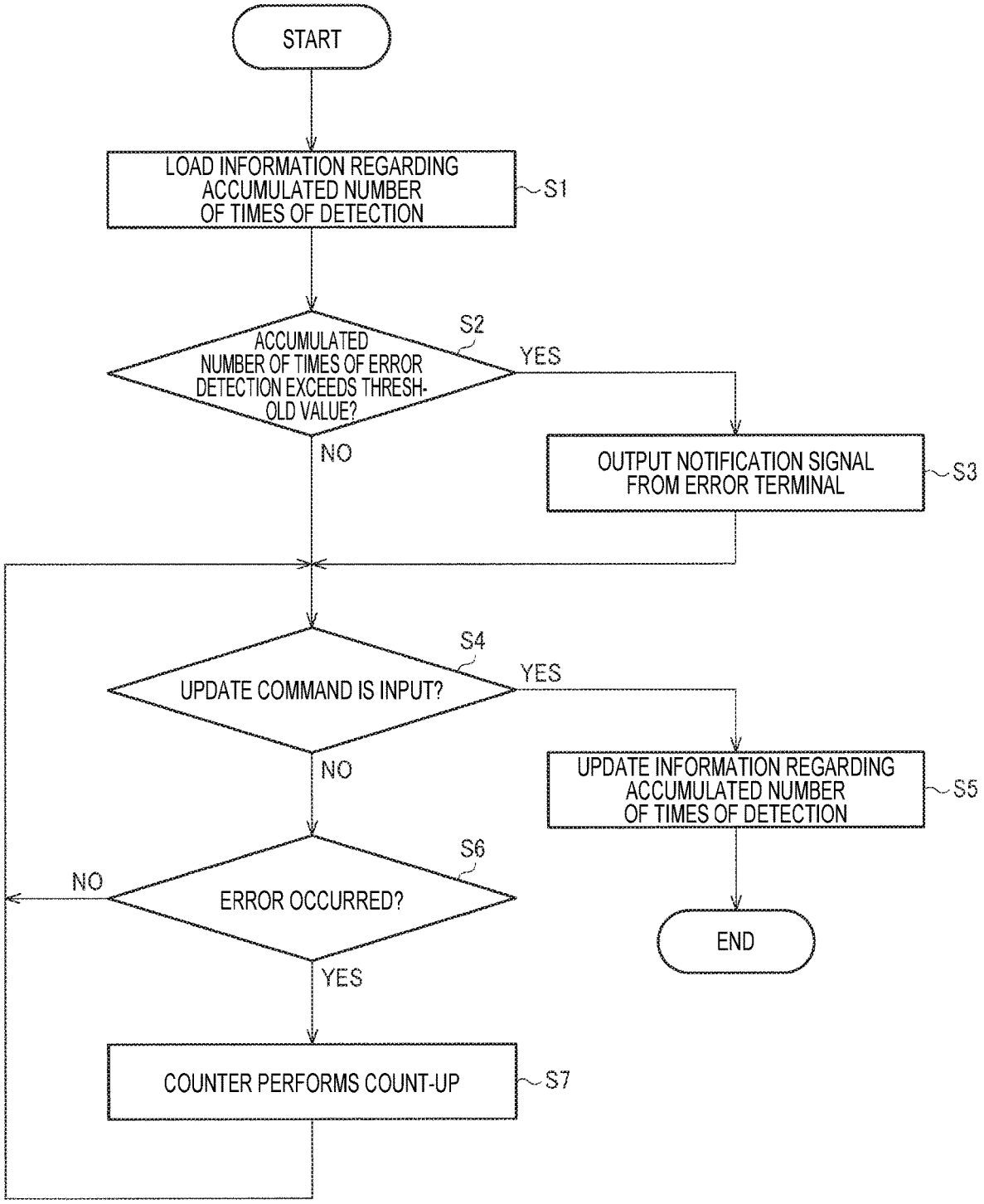
FIG. 6 is a flowchart illustrating operations relating to information regarding the accumulated number of times of detection.

FIG. 6 is a flowchart illustrating operations relating to information regarding the accumulated number of times of detection. The processing shown in FIG. 6 is started when the display driver 100 enters a reset-cancelled state from a reset state due to the reset signal XRES being turned to a high level, and the processing shown in FIG. 6 is ended when the display driver 100 enters a reset state from a reset-cancelled state due to the reset signal XRES being turned to a low level.

When the processing shown in FIG. 6 is started, the control circuit 110 loads information regarding the accumulated number of times of detection of an error from the nonvolatile memory 120 to the register 135, as shown in step S1. This information regarding the accumulated number of times of detection is the information regarding the accumulated number of times of detection updated in the previous operating period.

Next, as shown in step S2, the control circuit 110 determines whether or not the accumulated number of times of detection of an error indicated by the information regarding the accumulated number of times of detection exceeds a threshold value of accumulated number of times of detection. If the accumulated number of times of detection exceeds the threshold value of accumulated number of times of detection, the control circuit 110 outputs a notification signal from an error terminal, which is not illustrated, to the processing device 310, as shown in step S3, The notification signal is an interrupt signal to the processing device 310, for example.

If the accumulated number of times of detection does not exceed the threshold value of accumulated number of times of detection, in step S2, the control circuit 110 determines whether or not an update command has been input, as shown in step S4. The update command is a command for instructing updating of the information regarding the accumulated number of times of detection. For example, the state machine issues the update command in state ST7. The control circuit 110, upon receiving the update command, updates the information regarding the accumulated number of times of detection stored in the nonvolatile memory 120 to new information regarding the accumulated number of times of detection.

If it is determined, in step S4, that the update command has not been input, the control circuit 110 determines whether or not an error has occurred based on the error detection signal, as shown in step S6. If it is determined that an error has not occurred, the processing returns to step S4. If it is determined that an error has occurred, in step S6, the control circuit 110 instructs the counter 125 to count up, and the counter 125 counts up the count value, as shown in step S7. Then, the processing returns to step S4.

Figure 7:
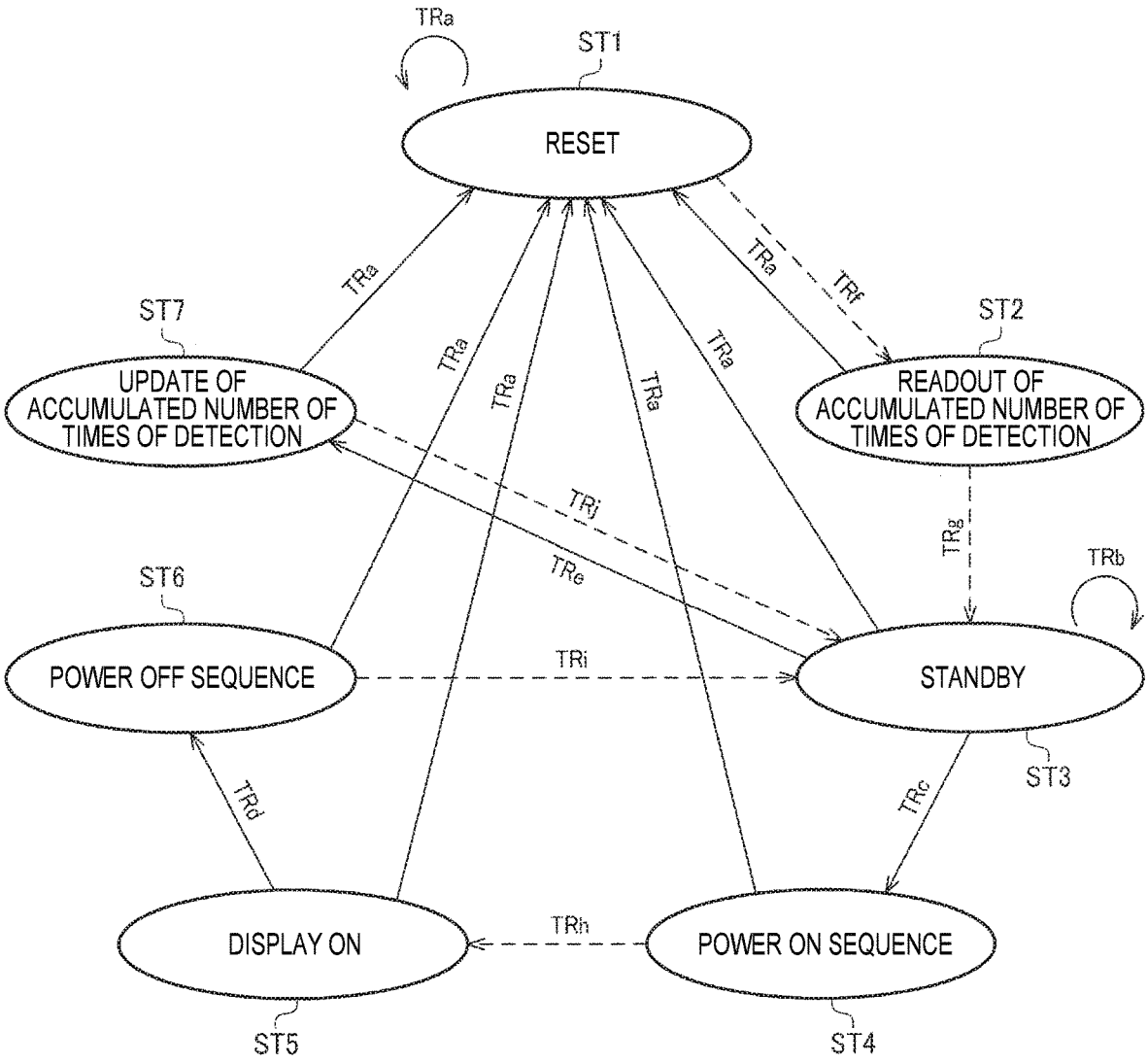
FIG. 7 is a state transition diagram of the display driver.

FIG. 7 is a state transition diagram of the display driver 100. The signs TRa to TRj indicate transitions between states.

State ST1 is a reset state. As indicated by TRa, in state ST1, display driver 100 is kept in state ST1 while being kept in a reset state by the reset signal. Also, in states ST2 to ST7, on the condition that the display driver 100 is caused to enter a reset state by the reset signal, the state transitions from states ST2 to ST7 to state ST1.

As indicated by TRf, the state machine automatically causes the state to transition from state ST1 to state ST2 after the reset is cancelled. In state ST2, the control circuit 110 reads out information regarding the accumulated number of times of detection from the nonvolatile memory 120.

As indicated by TRg, after the information regarding the accumulated number of times of detection is read out from the nonvolatile memory 120, the state machine automatically causes the state to transition from state ST2 to state ST3. State ST3 is a standby state. As indicated by TRb, the state machine keeps the state in state ST3 while initialization is performed by the initial setting command.

As indicated by TRc, on the condition that the processing device 310 inputs the display-on command to the display driver 100, the state machine causes the state to transition from state ST3 to state ST4. State ST4 is a state in which the power on sequence is executed.

As indicated by TRh, after the power on sequence has ended, the state machine automatically causes the state to transition from state ST4 to state ST5. State ST5 is a state in which the electro-optical panel 200 performs display.

As indicated by TRd, on the condition that the processing device 310 inputs the display-off command to the display driver 100, the state machine causes the state to transition from state ST5 to state ST6. State ST6 is a state in which the power off sequence is executed.

As indicated by TRi, after the power off sequence has ended, the state machine automatically causes the state to transition from state ST6 to state ST3.

As indicated by TRe, on the condition that the update command is input, the state machine causes the state to transition from state ST3 to state ST7. In state ST7, the control circuit 110 updates the information regarding the accumulated number of times of detection stored in the nonvolatile memory 120.

As indicated by TRj, after the information regarding the accumulated number of times of detection is updated, the state machine automatically causes the state to transition from state ST7 to state ST3.

Next, the error detection circuit 115 will be described in detail.

The error detection circuit 115 includes first to sixth detection circuits. The error detection circuit 115 outputs a logical sum of the first to sixth detection signals that are respectively output from the first to sixth detection circuits as the error detection signal.

The first detection circuit detects a register error. That is, the first detection circuit monitors whether or not the register value is a normal value, and, upon determining that the register value is an unexpected value, activates the first detection signal. A 1-bit register value is taken as an example. The register 135 includes a first latch circuit that stores the 1-bit register value, and a second latch circuit that stores a logically inverted value of the 1-bit register value. The first detection circuit obtains an exclusive OR of the output signal of the first latch circuit and the output signal of the second latch circuit. If the output signal of the first latch circuit is the same as the output signal of the second latch circuit, the exclusive OR of these signals is "0". At this time, the first detection circuit determines that an error has occurred, and activates the detection signal. For example, when the latch circuit is reset due to EMI, power supply noise, or the like, or when the data retained by the latch circuit is broken due to EMI, power supply noise, or the like, the register value takes an unexpected value.

The second detection circuit detects a state machine error. That is the second detection circuit monitors whether or not the state transition is proper, and upon determining that the state transition is improper, activates the second detection signal. The proper state transition is the state transition shown in FIG. 7, for example. The state machine monitors the state transition using a register, which is not illustrated, and the second detection circuit monitors the register. The second detection circuit, upon determining that a state transition has occurred that does not occur in the proper state transition, activates the second detection signal.

The third detection circuit detects an abnormal voltage of the system power supply. That is, the third detection circuit monitors whether or not the system power supply voltage is higher than a system power supply threshold voltage, and, upon determining that the system power supply voltage has decreased below the system power supply threshold voltage, activates the third detection signal. The third detection circuit is a comparator that compares the system power supply voltage with the system power supply threshold voltage, for example.

The fourth detection circuit detects an anomaly in a clock signal. That is, the fourth detection circuit monitors whether or not the clock signal has stopped, and, upon determining that the clock signal has stopped, activates the fourth detection signal. The clock signal is input to the interface circuit 180 from the outside of the display driver 100. Alternatively, the data interface 182 generates, based on display data input to the data interface 182, a clock signal that is synchronized with the display data.

The fifth detection circuit detects an abnormal stepped-up voltage generated by the power supply circuit 140. That is, the fifth detection circuit monitors whether or not the stepped-up voltage is higher than a stepped-up voltage threshold voltage, and, upon determining that the stepped-up voltage has decreased below the stepped-up voltage threshold voltage, activates the fifth detection signal. The fifth detection circuit is a comparator that compares the stepped-up voltage with the stepped-up voltage threshold voltage, for example.

The sixth detection circuit detects a display data error. That is, the sixth detection circuit monitors whether or not the display data that the data interface 182 has received is proper, and, upon determining that the display data is improper, activates the sixth detection signal. For example, the sixth detection circuit receives a CRC expected value of the display data from the processing device 310. The sixth detection circuit obtains a CRC value from the display data received by the data interface 182, compares the CRC value with the CRC expected value, and determines that an error has occurred when the CRC value is different from the CRC expected value.

Next, operations performed by the display driver 100 or the processing device 310 based on the information regarding the accumulated number of times of detection will be described. Hereinafter, the first to fourth exemplary operations will be described.

In the first exemplary operation, as described in step S1 in FIG. 6, the control circuit 110 reads out information regarding the accumulated number of times of detection from the nonvolatile memory 120 to the register 135. The processing device 310 reads out the information regarding the accumulated number of times of detection by accessing the register 135 via the command interface 181. The processing device 310 can read out the information regarding the accumulated number of times of detection at any timing. The processing device 310 determines whether or not the display driver 100 is in an anomalous state based on the information regarding the accumulated number of times of detection. For example, if the accumulated number of times of detection indicated by the information regarding the accumulated number of times of detection exceeds the threshold value of the accumulated number of times of detection, the processing device 310 determines that the display driver 100 is in an anomalous state. The processing device 310, upon determining that the display driver 100 is in an anomalous state, performs reporting processing. For example, the processing device 310 transmits display data of predetermined display contents to the display driver 100, and the display driver 100 causes the electro-optical panel 200 to display the display contents. Note that the reporting processing may be, other than the processing for reporting using an image display, processing for reporting using sound, light, vibration, or the like. Alternatively, the processing device 310, upon determining that the display driver 100 is in an anomalous state, may reset the display system including the display driver 100.

In the second exemplary operation, as described in step S3 in FIG. 6, if the accumulated number of times of detection exceeds the threshold value of accumulated number of times of detection, the control circuit 110 outputs the notification signal from the error terminal. The processing device 310, upon receiving the notification signal, performs the reporting processing. Alternatively, the processing device 310, upon receiving the notification signal, reads out the information regarding the accumulated number of times of detection by accessing the register 135 via the command interface 181. The processing device 310, upon determining that the display driver 100 is in an anomalous state based on the information regarding the accumulated number of times of detection, performs the reporting processing. Alternatively, the processing device 310, upon determining that the display driver 100 is in an anomalous state, may reset the display system including the display driver 100.

In the third exemplary operation, the display driver 100 performs the reporting processing. That is, the control circuit 110 determines whether or not the display driver 100 is in an anomalous state based on the information regarding the accumulated number of times of detection. The control circuit 110, upon determining that the display driver 100 is in an anomalous state, performs the reporting processing. For example, display data of predetermined display contents is stored in the nonvolatile memory 120 or the like. The control circuit 110 causes the electro-optical panel 200 to display an image based on the display data read out from the nonvolatile memory 120.

In the fourth exemplary operation, a plurality of pieces of information regarding the accumulated number of times of detection are acquired according to the importance of errors or the like. For example, as described in FIG. 1 and the like, the error detection circuit 115 outputs the first to $k^{th}$ detection signals. Here, the first to $k^{th}$ detection signals are divided into groups, and an error detection signal may be generated for each group. For example, the first to $k^{th}$ detection signals are assumed to be divided into a first group and a second group according to the importance of errors or the like. The error detection circuit 115 outputs a logical sum of the detection signals in the first group as a first error detection signal, and outputs a logical sum of detection signals in the second group as a second error detection signal. The counter 125 performs count processing based on the first error detection signal, and acquires first information regarding the number of times of detection. Also, the counter 125 performs count processing based on the second error detection signal, and acquires second information regarding the number of times of detection. The control circuit 110 writes the first information regarding the accumulated number of times of detection into the nonvolatile memory 120 based on the first information regarding the number of times of detection, and writes the second information regarding the accumulated number of times of detection into the nonvolatile memory 120 based on the second information regarding the number of times of detection. The processing device 310 or the display driver 100 performs first processing based on the first information regarding the accumulated number of times of detection and second processing based on the second information regarding the accumulated number of times of detection. The first processing may be different from the second processing. For example, the first processing may be reporting processing for displaying an image of first contents, and the second processing may be reporting processing for displaying an image of second contents. Alternatively, the first processing may be reporting processing, and the second processing may be processing for resetting the display system.

According to the embodiment described above, the information regarding the accumulated number of times of detection can be retained in the nonvolatile memory 120 even after the system power supply is turned off. Accordingly, the information regarding the accumulated number of times of detection in a period from when the accumulation of the number of times of error detection was started until now can be known.

Also, since the accumulated number of times of detection of an error is managed, even in a case of adopting a specification in which the error detection signal is activated in a short period of time, the error can be reliably reflected on the information regarding the accumulated number of times of detection. Accordingly, an error that has temporarily occurred during a display operation can be reliably recognized by a host side apparatus.

Also, as a result of monitoring the accumulated number of times of detection, the processing device 310 can recognize the frequency of error occurrence. Accordingly, the processing device 310 can perform processing according to the frequency of error occurrence. For example, the processing device 310 can perform reporting processing according to the frequency of error occurrence.

Also, the processing device 310 can determine the tendency of degradation of the display system based on the frequency of error occurrence. For example, the degradation of the display system by noise can be determined. Accordingly, the processing device 310 can perform a display for prompting a user to take actions such as replacing a component before the display system including the display driver 100 fails.

4. Electronic Apparatus, Mobile Body

Figure 8:
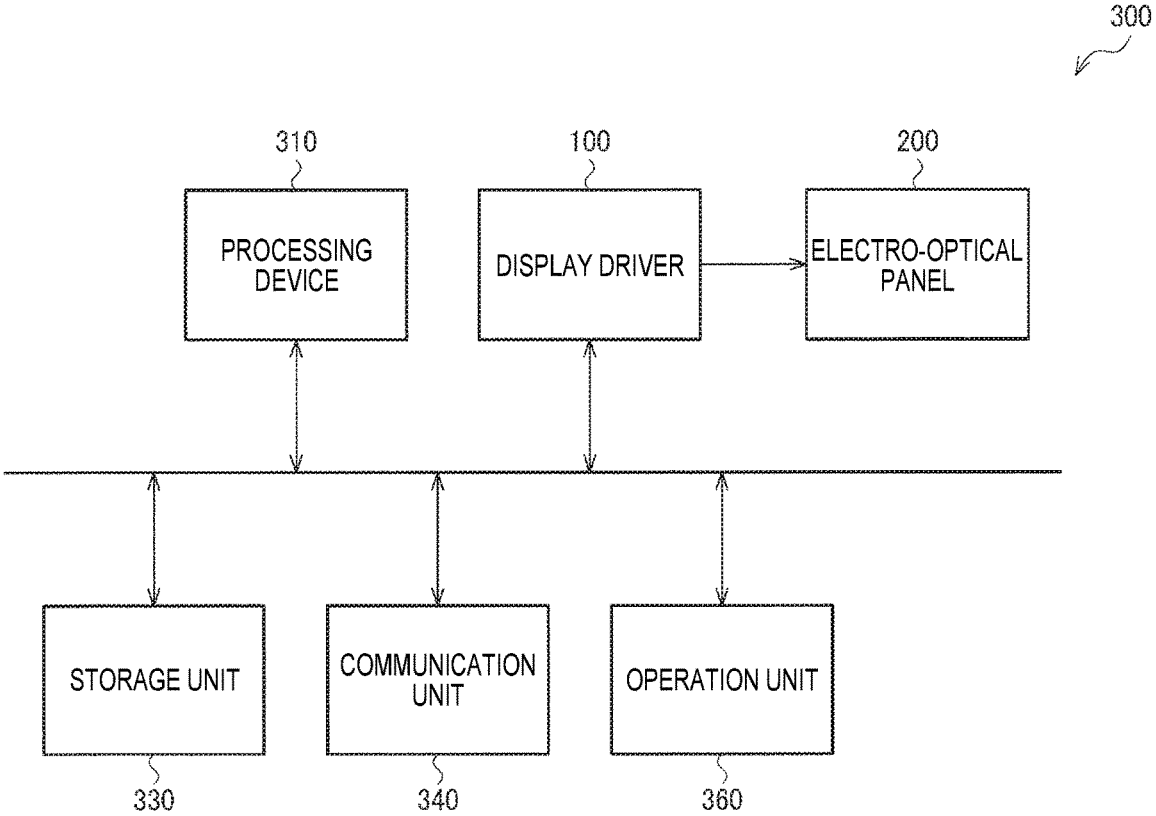
FIG. 8 shows an exemplary configuration of an electronic apparatus.

FIG. 8 shows an exemplary configuration of an electronic apparatus 300 including the display driver 100. The electronic apparatus 300 includes the processing device 310, the display driver 100, the electro-optical panel 200, a storage unit 330, a communication unit 340, and an operation unit 360. The display driver 100 may also be referred to as a display driver. The storage unit 330 may also be referred to as a storage device or a memory. The communication unit 340 may also be referred to as a communication circuit or a communication device. The operation unit 360 may also be referred to as an operation device. Various types of electronic apparatuses on which the display device is mounted can be envisioned as specific examples of the electronic apparatus 300. For example an on-board device, a projector, a head mounted display, a mobile information terminal, a mobile game terminal, an information processing device, or the like can be envisioned as the electronic apparatus 300. The on-board device is a meter panel, a car navigation system, or the like.

The operation unit 360 is a user interface for receiving various operations made by a user. For example, the operation unit 360 is constituted by a button, a mouse, a keyboard, a touch panel attached to the optical panel 200, and the like. The communication unit 340 is a data interface for performing input and output of display data and control data. The communication unit 340 is a wireless communication interface such as a wireless LAN or near field wireless communication, or a wired communication interface such as a wired LAN or a USB, for example. The storage unit 330 stores data input from the communication unit 340, or functions as a working memory of the processing device 310, for example. The storage unit 330 is a memory such as a RAM or a ROM, a magnetic storage device such as an HDD, an optical storage device such as a CD drive or a DVD drive, or the like. The processing device 310 processes display data input from the communication unit 340 or display data stored in the storage unit 330, and transfers the processed display data to the display driver 100. The display driver 100 causes the electro-optical panel 200 to display an image based on the display data transferred from the processing device 310. Also, the processing device 310 performs processing for controlling the electronic apparatus 300 and various types of signal processing. The processing device 310 is constituted by a processor such as a CPU or an MPU, an ASIC, or the like.

Figure 9:
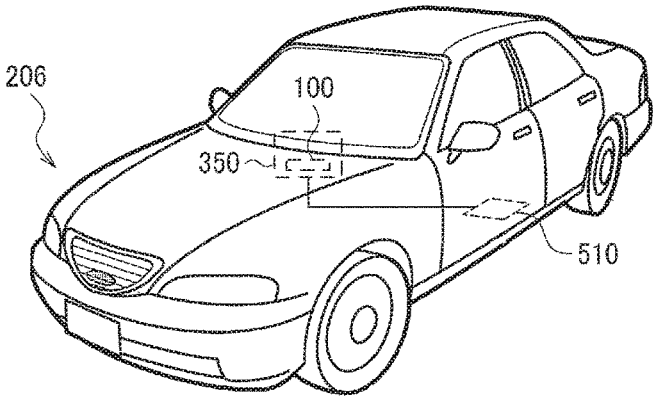
FIG. 9 shows an exemplary configuration of a mobile body.

FIG. 9 shows an exemplary configuration of a mobile body including the display driver 100. The mobile body is an apparatus or device that includes a drive mechanism such as an engine or a motor, steering mechanisms such as a steering wheel or a rudder, and various electronic apparatuses, for example, and moves on the ground, in the air, or on the sea. A car, an airplane, a motorcycle, a ship, a robot, or the like can be envisioned as the mobile body of the present embodiment.

FIG. 9 schematically illustrates an automobile 206 serving as a specific example of the mobile body. A display device 350 including the display driver 100 and an ECU 510 that controls the units of the automobile 206 are built into the automobile 206. The display device 350 is an electro-optical device. The ECU 510 is a processing device. The ECU 510 generates an image to be displayed to a user, and transmits the image to the display device 350. The display device 350 displays the received image. For example, pieces of information such as speed, remaining fuel amount, travel distance, and settings of various types of devices are displayed as an image.

According to the embodiment described above, the display driver includes a drive circuit that drives an electro-optical panel and a control circuit that controls the drive circuit. The display driver includes: an error detection circuit configured to detect an error in the display driver; and a counter configured to perform count processing with respect to information regarding the number of times of detection of the error in an operating period of the display driver. The control circuit performs control such that information regarding the accumulated number of tip e f detection of the error is stored in a nonvolatile memory that can retain storage contents even if power is not supplied, based on the information regarding the number of times of detection.

According to the present embodiment, the information regarding the accumulated number of times of detection of an error is written into a nonvolatile memory based on information regarding the number of times of detection acquired in an operating period of the display driver. With this, the information regarding the accumulated number of times of detection is retained in the nonvolatile memory even in a period in which power is not supplied to the display driver. Accordingly, the display driver can output information regarding the accumulated number of times of detection over a plurality of operating periods to a processing device. The processing device can determine whether or not the display driver is in an anomalous state based on the information regarding the accumulated number of times of detection.

Also, in the present embodiment, the control circuit may, after a reset of the display driver is cancelled, read out the information regarding the accumulated number of times of detection from the nonvolatile memory, and update the information regarding the accumulated number of times of detection stored in the nonvolatile memory, based on the information regarding the number of times of detection.

As a result of the control circuit reading out the information regarding the accumulated number of times of detection from a nonvolatile memory, the processing device can read out the information regarding the accumulated number of times of detection from the display driver. Alternatively, as a result of the circuit reading out the information regarding the accumulated number of times of detection from the nonvolatile memory, the control circuit can perform reporting processing or the like based on the information regarding the accumulated number of times of detection. Also, the control circuit can update the information regarding the accumulated number of times of detection based on the information regarding the number of times of detection and the information regarding the accumulated number of times of detection that has been read out from the nonvolatile memory, Note that the control circuit may update the information regarding the accumulated number of times of detection by writing the information regarding the number of times of detection into the nonvolatile memory without using the information regarding the accumulated number of times of detection that has been read out from the nonvolatile memory.

Also, in the present embodiment, the control circuit may update the information regarding the accumulated number of times of detection stored in the nonvolatile memory in a period from when display of the electro-optical panel is turned off until the display driver is reset.

When the operating period of the display driver is ended, the display of the display driver is turned off and then the display driver is reset. As a result of the information regarding the accumulated number of times of detection being updated in a period after the display is turned off until the display driver is reset, the information regarding the number of times of detection of an error in the operating period is accumulated as the information regarding the accumulated number of times of detection.

Also, in the present embodiment, the control circuit may regularly update the information regarding the accumulated number of times of detection stored in the nonvolatile memory in the operating period.

In this way, the information regarding the accumulated number of times of detection, at this point in time, can be regularly stored in the nonvolatile memory in a middle of the operating period as well. For example, assume that the operating period is not ended through a normal procedure due to the reduction in the system power supply or the like. According to the present embodiment, the information regarding the accumulated number of times of detection can be updated even in such a case.

Also, in the present embodiment, the control circuit may update the information regarding the accumulated number of times of detection stored in the nonvolatile memory on the condition that a number of times of detection indicated by the information regarding the number of times of detection exceeds a threshold value.

In this way, even in the middle of the operating period, when the number of times of error detection exceeds a threshold value, the information regarding the accumulated number of times of detection at this point in time can be stored in the nonvolatile memory. For example, assume that the operating period is ended not through a normal procedure due to the reduction in the system power supply or the like. According to the present embodiment, the information regarding the accumulated number of times of detection can be updated even in a case where the operating period is ended not through a normal procedure.

Also, in the present embodiment, the control circuit may update the information regarding the accumulated number of times of detection by writing information based on the information regarding the number of times of detection in a memory region of the nonvolatile memory that is different from a memory region in which the information regarding the accumulated number of times of detection before updating is stored.

According to the present embodiment, new information regarding the accumulated number of times of detection is written in a memory region in which information regarding the accumulated number of times of detection is not written. With this, even if the nonvolatile memory is an OTP memory, the information regarding the accumulated number of times of detection can be updated based on the information regarding the number of times of detection of an error.

Also, in the present embodiment, when the information regarding the accumulated number of times of detection is stored in first to $m^{th}$ bits (m is an integer of n−1 or less) of first to $n^{th}$ bits (n is an integer of 2 or more) in the nonvolatile memory, the control circuit may update the information regarding the accumulated number of times of detection by performing writing to a $m+1^{th}$ bit of the first to $n^{th}$ bits.

According to the present embodiment, as a result of writing being performed to a $m+1^{th}$ bit that is different from first to $m^{th}$ bits in which the information regarding the accumulated number of times of detection before updating is written, the information regarding the accumulated number of times of detection can be updated. Also, the information regarding the accumulated number of times of detection can be updated simply by performing bitwise writing, and therefore the update can be performed with simple processing. That is, new information regarding the accumulated number of times of detection need not be computed from information regarding the accumulated number of times of detection read out from the nonvolatile memory and the information regarding the number of times of detection acquired from a counter.

Also, in the present embodiment, the control circuit may, upon determining that the display driver is in an anomalous state based on the information regarding the accumulated number of times of detection, perform reporting processing of the anomalous state.

In this way, the display driver by itself can perform processing for reporting an anomalous state. For example, without the processing device having to determine an anomalous state based on the information regarding the accumulated number of times of detection, the display driver can determine whether or not its state is an anomalous state, and the display driver can perform reporting processing based on the result of the determination.

Also, in the present embodiment, the operating period may be a period including a reset-cancelled period of the display driver.

The reset-cancelled period is a period from when the reset of the display driver is cancelled until the display driver is reset. Specifically, the reset-cancelled period is a period in which the reset of the display driver is cancelled based on a reset signal input to the display driver. According to the present embodiment, the information regarding the accumulated number of times of detection can be updated based on the number of times of error detection in a reset-cancelled period.

Also, in the present embodiment, the counter is initialized when the display driver is reset.

As a result of the counter performing count processing, the information regarding the number of times of detection of an error is acquired. According to the present embodiment, the counter is initialized when the display driver is reset, and therefore, the information regarding the number of times of detection is initialized when the display driver is reset. According to the present embodiment, the information regarding the accumulated number of times of detection is written into a nonvolatile memory based on the information regarding the number of times of detection, and therefore the information regarding the accumulated number of times of detection can be retained in the nonvolatile memory even if the display driver is reset.

Also, in the present embodiment, the error may be at least one of a register error, a state machine error, a voltage error, a clock signal error, and a display data error.

In the display driver, various errors described above can be envisioned. According to the present embodiment, these errors can be detected, and the information regarding the number of times of detection of these errors is acquired. Also, the information regarding the accumulated number of times of detection is written into the nonvolatile memory based on the information regarding the number of times of detection.

Also, in the present embodiment, an electronic apparatus includes the display driver and a processing device that controls the display driver.

Also, in the present embodiment, the processing device may perform, upon determining that the display driver is in an anomalous state based on the information regarding the accumulated number of times of detection, reporting processing associated with the anomalous state.

Also, in the present embodiment, a mobile body may include a display driver and a processing device that controls the display driver.

Note that although an embodiment has been explained in detail above, a person skilled in the art will readily appreciate that it is possible to implement numerous variations and modifications that do not depart substantially from the novel aspects and effect of the invention. Accordingly, all such variations and modifications are also to be included within the scope of the invention. For example, terms that are used within the description or drawings at least once together with broader terms or alternative synonymous terms can be replaced by those other terms at other locations as well within the description or drawings. Also, all combinations of the embodiment and variations are also encompassed in the range of the invention. Moreover, the configuration and operation of the display driver, the electronic apparatus, and the mobile body are not limited to those described in the present embodiment, various modifications are possible.

What is claimed is:

1. A display driver including a drive circuit that drives an electro-optical panel and a control circuit that controls the drive circuit, the display driver comprising:

an error detection circuit configured to detect an error in the display driver; and a counter configured to perform count processing with respect to information regarding accumulated number of times of detection of the error in operation of the display driver, the accumulated number including a number of times of detection of the error that is accumulated during a first operation period and stored in a nonvolatile memory and a number of times of detection of the error that is accumulated during a second operation period, the second operation period being a period after the first operation period has ended and a period at the beginning of which the number of times of detection of the error accumulated during the first operation period is read out from the nonvolatile memory to be updated, wherein the control circuit is configured to perform control such that the information regarding the accumulated number of times of detection of the error is stored in the nonvolatile memory based on the number of times of detection accumulated during the first operation period, and such that the nonvolatile memory retains storage contents even if power is not supplied.

2. The display driver according to claim 1, wherein the control circuit, after a reset of the display driver is cancelled, reads out the information regarding the accumulated number of times of detection from the nonvolatile memory, and updates the information regarding the accumulated number of times of detection stored in the nonvolatile memory, based on the information regarding the number of times of detection.

3. The display driver according to claim 2, wherein the control circuit updates the information regarding the accumulated number of times of detection stored in the nonvolatile memory in a period from when display of the electro-optical panel is turned off until the display driver is reset.

4. The display driver according to claim 2, wherein the control circuit regularly updates the information regarding the accumulated number of times of detection stored in the nonvolatile memory in the operating period.

5. The display driver according to claim 2, wherein the control circuit updates the information regarding the accumulated number of times of detection stored in the nonvolatile memory on the condition that a number of times of detection indicated by the information regarding the number of times of detection exceeds a threshold value.

6. The display driver according to claim 1, wherein the control circuit updates the information regarding the accumulated number of times of detection by writing information based on the information regarding the number of times of detection in a memory region of the nonvolatile memory that is different from a memory region in which the information regarding the accumulated number of times of detection before updating is stored.

7. The display driver according to claim 1, wherein, when the information regarding the accumulated number of times of detection is stored in first to mth bits (m is an integer of n−1 or less) of first to nth bits (n is an integer of 2 or more) in the nonvolatile memory, the control circuit updates the information regarding the accumulated number of times of detection by performing writing to a m+1th bit of the first to nth bits.

8. The display driver according to claim 1, wherein the control circuit, upon determining that the display driver is in an anomalous state based on the information regarding the accumulated number of times of detection, performs reporting processing of the anomalous state.

9. The display driver according to claim 1, wherein the operating period is a period including a reset-cancelled period of the display driver.

10. The display driver according to claim 1, wherein the counter is initialized when the display driver is reset.

11. The display driver according to claim 1, wherein the error is at least one of a register error, a state machine error, a voltage error, a clock signal error, and a display data error.

12. An electronic apparatus comprising:

the display driver according to claim 1; and a processing device configured to control the display driver.

13. The electronic apparatus according to claim 12, wherein the processing device performs, upon determining that the display driver is in an anomalous state based on the information regarding the accumulated number of times of detection, reporting processing associated with the anomalous state.

14. A mobile body comprising:

a display driver according to claim 1; and a processing device configured to control the display driver.

* * * * *